US005203625A

United States Patent [19]

Naum

[11] Patent Number: 5,203,625

[45] Date of Patent: Apr. 20, 1993

[54] DIFFUSION SYSTEM

[76] Inventor: Daniel Naum, 1430 Williamette St., Ste. 18, Eugene, Oreg. 97401

[21] Appl. No.: 817,094

[22] Filed: Jan. 6, 1992

[51] Int. Cl.[5] ..... F21L 7/00

[52] U.S. Cl. ..... 362/202; 362/206; 362/346

[58] Field of Search ..... 362/202, 205, 346

[56] References Cited

U.S. PATENT DOCUMENTS

| | | | |
|---|---|---|---|
| 1,820,543 | 8/1931 | Reed | 362/346 |
| 4,276,633 | 6/1981 | Takami et al. | 368/227 |
| 4,429,004 | 1/1984 | Breitenfellner | 362/341 |
| 4,521,834 | 6/1985 | Orr | 362/202 |
| 4,735,495 | 4/1988 | Henkes | 362/310 |
| 5,023,758 | 6/1991 | Allen et al. | 362/346 |
| 5,101,325 | 3/1992 | Davenport et al. | 362/26 |

*Primary Examiner*—Carroll B. Dority
*Attorney, Agent, or Firm*—Ralph S. Branscomb

[57] ABSTRACT

A mixture of approximately 95% barium sulfate and 5% polyvinyl alcohol in powdered form is mixed into a solvent, heated and sprayed onto a diffusion surface to be used in conjunction with high-intensity lamps ranging from 200 watts to 18 kilowatts to convert the irregular lighting from these sources to a smooth, broad, even diffused source suitable for use in motion picture and television settings and other situations in which a very bright, but soft, evenly dispersed light is desirable.

1 Claim, 1 Drawing Sheet

DIFFUSION SYSTEM

BACKGROUND OF THE INVENTION

The invention is in the field of high-intensity lamps such as the kind used in motion picture and television productions, as well as in a number of other applications. In recent years there has been a growing interest in the application of medium arc metal halide lamps such as HMI (Hydrargyrum Medium arc length Iodide) type light sources, which are high pressure mercury discharge lamps additionally filled with precise quantities of rare earth metals such as Dysprosium, Holmium and Thallium to yield bright, efficient lighting in the desired visible spectrum. The added materials are included in halide form to create a balanced chemical system to retard bulb wall blackening and degradation of the electrodes.

Typically, these lamps produce a light output which simulates sunlight, operating at approximately 5600° Kelvin (° K) and an efficiency of 100 lumens per watt. The light produced is extremely intense, and bright colors on stage sets and the like are brought out brilliantly by the lamps because of their high intensity and optimal spectral distribution. The arc lengths varies from lamp to lamp, from about 1 cm. to 4½ cm. depending on overall lamp size.

Although these lamps are built into different types of reflector systems, or in some cases provided without reflectors at all, in all cases the light is discharged onto the scene or work area as a bath of uneven light with hot and cold spots, and color fringing areas, which create an undesired, uneven color temperature and intensity variation throughout the illuminated area.

These lights themselves are marvelous in their intensity, efficiency and spectral distribution. There is a need, however, for a system of diffusing the intense light produced by these lamps so that the uneven illumination with hot and cold spots that the lamps produced is replaced a smooth, even blanket of light which is virtually completely uniform from one spot to the next within the illuminated area.

SUMMARY OF THE INVENTION

The invention fulfills the above-stated need by providing a special coating and a method for creating the coating, and reflectors utilizing the coating which completely diffuse the light from these high-intensity lamps before the light reaches the illuminated scene.

An intense, narrow HMI beam can be converted into a soft, smoothly spread light when the diffusion module of the instant invention is installed over the HMI lamp. For example, a 10° beam angle from a high-intensity lamp impinging upon the reflective surfaces of the diffusion module of the invention is converted into a 180° "lambertian" source. A "lambertian" source is a term used for a surface which is angle-independent in that light impinging from any angle is reflected at a uniform intensity at all angles of reflection or diffusion. The illuminated surface is uniform irrespective of the angle from which it is viewed.

The invention permits the conversion of a narrow beam with an uneven output, such as an HMI or tungsten halogen light source, into a uniform lambertian light source. Such light souces are useful for film, video, industrial, scientific, and photographic use. The light from the source is neither collimated, focused or restricted to a divergent cone. Reflection of incident light is approximately 99% over most of the visible spectrum.

The coating which makes this type of performance possible is on the order of 95% barium sulfate and 5% polyvinyl alcohol, both of which are in powdered form and are mixed with a solvent or carrier comprised of ethanol and water, and then sprayed onto the reflective surfaces.

DETAILED DESCRIPTION OF THE PREFERRED EMBODIMENTS

Figure 1:
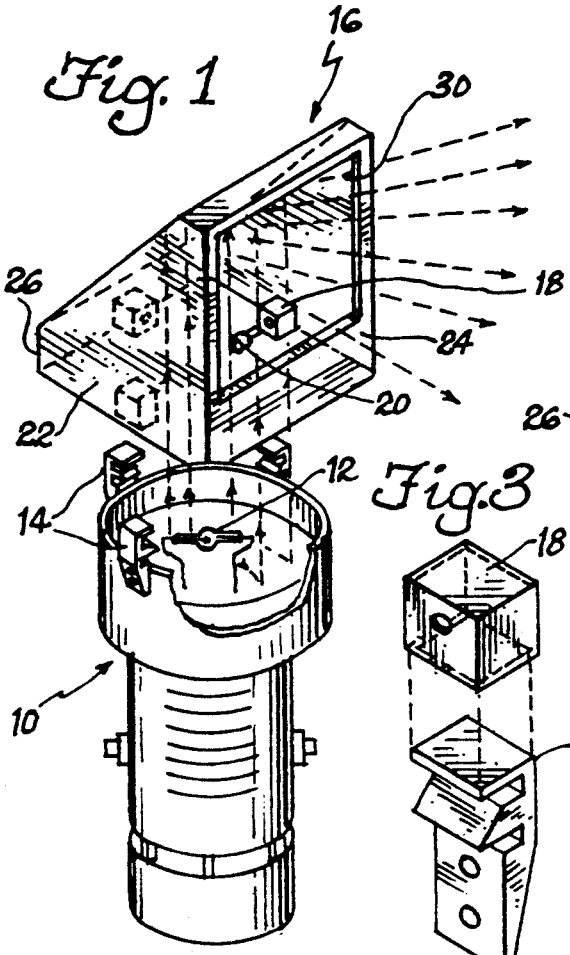
FIG. 1 is a perspective view of a reflector exploded from the high-intensity lamp to which it attaches.
Figure 2:
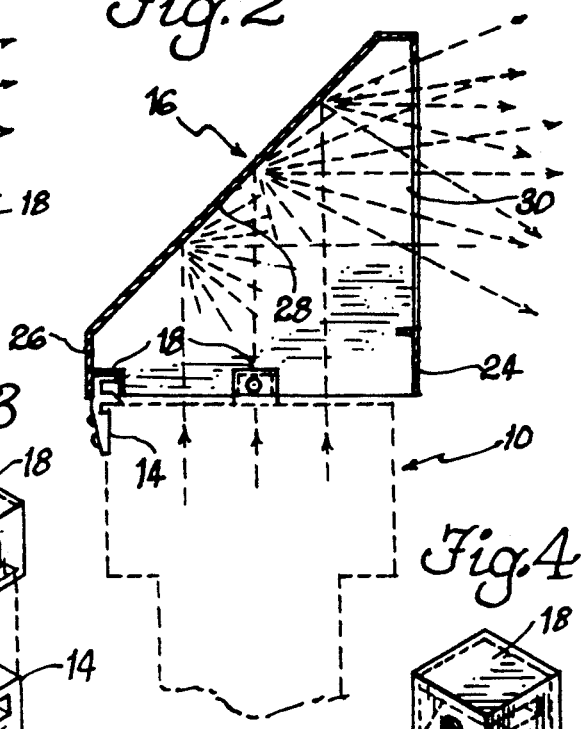
FIG. 2 is a side elevation view of the diffusion module of FIG. 1 illustrating typical light ray paths for the diffuser.
Figure 3:
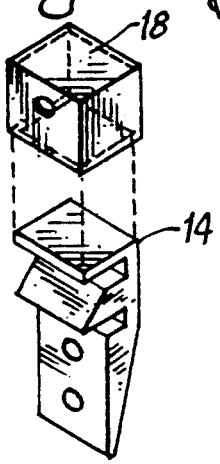
FIG. 3 illustrates the connector mechanism between the lamp and the diffusion module.
Figure 4:
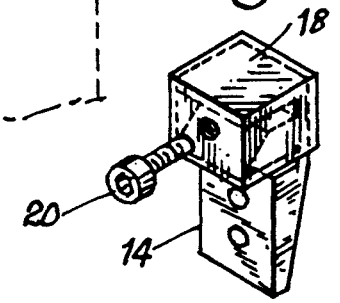
FIG. 4 illustrates the structure of FIG. 3 in the connected mode.

The coating which forms the heart of the invention is comprised of 95% barium sulfate ($BaSO_4$) and 5% polyvinyl alcohol $[-CH_2CH(OH)-]_x$. Although these percentages obviously could vary somewhat, 95% to 5% is close to an ideal ratio. The barium sulfate is the reflective material, and though in fact it is transparent when produced in large crystals, it is highly diffusive when produced in powder form, which in insoluble. The polyvinyl alcohol, also produced in powder form, is a binder which holds the barium sulfate together to create a coating which will adhere to a surface, rather than the loose powder represented by the barium sulfate alone. In some instances, it will be desirable to add a pigment to the mixture, such as a blue or amber-type pigment. The amount of pigment added would ordinarily represent less than 5% of the total mixture.

If the percentage of barium sulfate rises much above 95%, there is insufficient adhesion in the mixture for it to bond to a surface to provide a suitable diffusion surface. On the other hand, increasing the percentage of polyvinyl alcohol much beyond 5% creates a gummy mixture that does not reflect as well as it should and may not dry properly.

For these reasons, whereas the 95% to 5% proportion is deemed ideal, it would be possible to also increase the polyvinyl alcohol up to 10% or decrease it to 2%, with a balance being barium sulfate and still achieve a functional result.

As indicated above, both of these compounds are provided in powder form. In order to produce them in a form which will bind to an aluminum surface which is used for the diffusion modules, the following technique is used:

1. A mixture of 95%-pure ethanol ($C_2H_5OH$) is mixed with distilled water in an approximately 1:1 ratio. This 50—50 mixture is then heated to approximately 60° centigrade. At this point, the polyvinyl alcohol is mixed into the solvent solution. The polyvinyl alcohol dissolves well in the ethanol as well as in the water, and becomes completely dissolved and homogenous after the mixture is stirred for a short time.

2. After this homogenous mixture is made, which is termed "new mixture" to distinguish it from the solvent solution mixture of the ethanol and water, the barium sulfate, which has been preferably dry-blended to eliminate any lumps, is added.

3. The hot mixture of ethanol, distilled water, polyvinyl alcohol, and barium sulfate powder is then mixed while warm for at least 15 minutes to achieve a homogenous mixture of the alcohols and water, and a uniform suspension of the minute particulate barium sulfate.

4. At this point, the mixture is sprayed through a high-viscosity sprayer onto an aluminum surface, or other surface which will result in being the diffusion surface. When creating the products described below in this disclosure, the mixture is sprayed over the aluminum surface five times to achieve a relatively thick diffusion coating, which is as much as 1 mm. thick.

The diffusion modules on which the above-described coating is applied are illustrated in FIGS. 1 through 5. An HMI sealed beam type lamp of standard configuration as shown at 10 in FIG. 1. This lamp has an illuminating element within a bulb 12, which is not part of this invention inasmuch as the entire lamp structure 10 is standard construction. The lamp structure has four filter mounting points 14 to which the diffusion module 16 mounts through the use of the screw mounts 18 through which screws 20 are inserted to engage in the mounting points 14 of the HMI lamp 10.

The screw mounts 18 are mounted on the four sides of the module. The module has two generally triangular side walls 22, a short front wall 24, a short rear wall 26, and a large diffusion surface 28 which strikes a substantially 45° angle between the incident rays from the bulb 12 and the aperture or opening 30 through which the diffused light passes to illuminate the stage setting or whatever.

The majority of the light reflected through the aperture 30 is diffused off of the diffusion surface 28. However, all of the interior surfaces of the diffusion module are coated with the diffusion coating, so that in many instances, emitted light will have been reflected more than once before being emitted through the opening 30. This has the effect of producing a fairly uniform illumination over about 180° with there being a slight increase in intensity in the forward direction, in front of the aperture.

Figure 6:
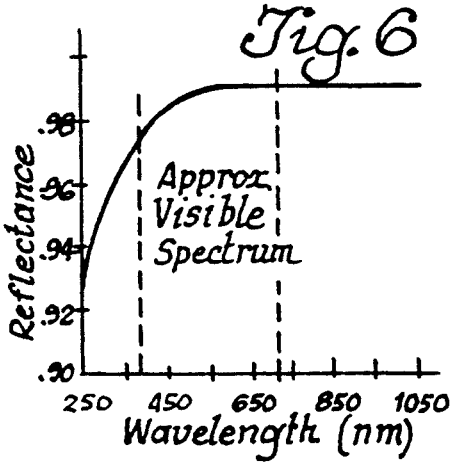
FIG. 6 graphs the percent reflectance from the coated surface as a function of wavelengths of incident light.

FIG. 6 illustrates the reflectance of the material over the electromagnetic spectrum. Visible light begins at about 380 nanometers, and extends to about 700 nanometers at the upper end of the violet portion of the spectrum. This range is illustrated in dotted lines in FIG. 6. As can be seen, wave lengths above approximately 500 nanometers are reflected at 99% of their original intensity, with their reflectivity dropping off to about 98% at the bottom of the visible spectrum. Thus, with such an extremely high reflectivity rate, the multiple reflections within the diffusion module do not seriously attenuate the level of visible light emitted through the aperture.

Figure 5:
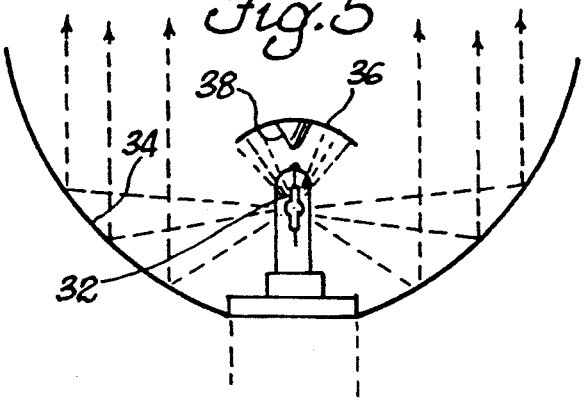
FIG. 5 illustrates a variation of the diffusion reflector system.

A different physical arrangement with approximately the same end result is shown in FIG. 5, in which a single-ended lamp 32 is used rather than the HMI lamp of FIG. 1. In this case, there are two diffusion reflectors, the main one indicated at 34 and a cap diffusion reflector 36, preferably having a central cone 38, set forth in one of the inventors prior patents, which prevents light from the lamp 32 from being reflected directly back onto itself.

The cone 38 disperses the light onto the main reflector 34, and as the ray diagrams in FIG. 5 plainly indicate, reflected light would effectively be directed upwardly in the sense of FIG. 5, and in the case of the diffusion coating, naturally there will be a generally lambertian dispersion of light in all directions covering about 180°. Light from the cap diffuser 36 strikes the main diffuser 34, from which in turn may impinge upon another portion of the main diffuser, and so forth, until the multiply diffused rays finally emerge from the structure, creating a soft, uniform light source.

The diffusion modules shown are exemplary in nature only, and obviously could be replaced by others similar in nature but having the same basic end result. They accommodate the advantages of the state-of-art, high-intensity, high-efficiency lamps, enabling them to be used in a softer, diffused mode required in so many application which would cause their exclusion otherwise.

The coating that is used will withstand temperatures up to 130° Centigrade and has the advantage of reducing the temperature immediately in front of the diffuser to below a relatively safe 80° Centigrade, at a point where it would be 200° Centigrade or more without the diffuser. Temperatures this high will burn, discolor or fade all gel-type filters that are used with this type of lights. Thus, this particular coating and its formulation, and the diffusion modules which use the coating, represent an entire technology and product line that is made practical and possible by the development of the high-intensity lights described above.

It is hereby claimed:

1. Add-on diffuser module attachment for a high-intensity HMI lamp having a light source within a light casing and having spaced filter mounting supports extending from said casing, said diffuser module attachment comprising:

(a) a housing having a light entrance opening and a light exit opening approximately 90° from said entrance opening and spaced screw mounts position about said light entrance opening and adapted to engage said filter mounting supports to mount said housing to the casing of a high-intensity lamp;

(b) said housing defining a primary reflecting surface at an angle of on the order of 45° between said light entrance opening and said light exit opening; and (c) substantially the complete interior surface of said enclosure including all of said primary reflective surface having a coating of highly diffusive material comprising on the order of 95% barium sulfate thereon such that light form a high-intensity lamp to which said housing is mounted will be diffused and integrated and exit through said opening as high-intensity lambertian light.

* * * * *